US007942708B2

(12) United States Patent
Ohsako

(10) Patent No.: US 7,942,708 B2
(45) Date of Patent: May 17, 2011

(54) ELECTRICAL CONNECTOR AND TERMINAL FOR ELECTRICAL CONNECTOR

(75) Inventor: Tetsutaro Ohsako, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 12/603,016

(22) Filed: Oct. 21, 2009

(65) Prior Publication Data

US 2010/0105229 A1 Apr. 29, 2010

(30) Foreign Application Priority Data

Oct. 27, 2008 (JP) ..... 2008-275578

(51) Int. Cl.
*H01R 13/514* (2006.01)

(52) U.S. Cl. ..... 439/752

(58) Field of Classification Search ..... 439/752, 439/752.5, 352, 259, 595
See application file for complete search history.

(56) References Cited

U.S. PATENT DOCUMENTS

| | | | | |
|---|---|---|---|---|
| 5,593,328 | A * | 1/1997 | Okada et al. | 439/851 |
| 7,311,561 | B2 * | 12/2007 | Anbo et al. | 439/752.5 |
| 2007/0270020 | A1 * | 11/2007 | Shuey | 439/420 |
| 2010/0105229 | A1 * | 4/2010 | Ohsako | 439/259 |

FOREIGN PATENT DOCUMENTS

| | | | |
|---|---|---|---|
| EP | 1303008 | | 4/2003 |
| JP | 04-255677 | A | 9/1992 |
| JP | 2002-170619 | A | 6/2002 |
| JP | 2002-190342 | A | 7/2002 |
| JP | 2002-373728 | A | 12/2002 |
| JP | 2003-243065 | A | 8/2003 |
| JP | 2004-014304 | A | 1/2004 |
| JP | 2004-281207 | A | 10/2004 |
| JP | 2005-044586 | A | 2/2005 |
| JP | 2005-243359 | A | 9/2005 |
| JP | 2006-216319 | A | 8/2006 |
| JP | 2006-216320 | A | 8/2006 |

OTHER PUBLICATIONS

Japan Patent Office, Office Action for Application 2008-275578, Oct. 28, 2010.

* cited by examiner

*Primary Examiner* — Briggitte R Hammond
(74) *Attorney, Agent, or Firm* — Kubotera & Associates LLC

(57) ABSTRACT

An electrical connector includes a housing and a terminal. The housing includes a terminal hole and a lance portion disposed in the terminal hole. The lance portion includes a guide surface; an engaging front edge surface; and a regulated surface. The terminal includes a contact portion; a connection portion; an engaging portion; a curved portion; and a regulating portion. The engaging portion pushes the guide surface to deform and is guided with the guide surface when the terminal is inserted into the terminal hole. When the terminal is completely fitted in the terminal hole, the engaging portion faces the engaging front edge surface and engages the lance portion.

12 Claims, 7 Drawing Sheets

ELECTRICAL CONNECTOR AND TERMINAL FOR ELECTRICAL CONNECTOR

BACKGROUND OF THE INVENTION AND RELATED ART STATEMENT

The present invention relates to an electrical connector and a terminal for the electrical connector. More specifically, the present invention relates to an electrical connector including a housing having a lance portion disposed in a terminal hole of the housing, and a terminal for the electrical connector including an engaging portion for engaging the lance portion.

Patent Reference has disclosed a conventional electrical connector. According to Patent Reference, a terminal is inserted from a contacting portion situated at a front side thereof into a terminal hole of a housing in a state that a cable is connected to a rear portion of the terminal.

Patent Reference Japanese Patent Publication No. 2004-281207

In the conventional electrical connector, the terminal includes an engaging portion for preventing coming off from the housing. The engaging portion engages a front end surface of a lance portion provided in the housing. The lance portion has a stem-like shape and obtains elasticity. When the terminal is inserted into the terminal hole of the housing, the engaging portion passes over where the lance portion is situated, since the lance portion deforms elastically upon being pushed by the engaging portion. When the terminal is fitted completely, the lance portion is released from the elastic deformation and engages the engaging portion with the front end surface thereof.

After the terminal is fitted completely, a key member having a box shape is fitted to the housing. An outer surface of the lance portion closely faces the key member. Accordingly, the lance portion does not deform elastically outward. Consequently, the engaging portion maintains a state of engaging the lance portion even when the terminal inadvertently receives a pulling force via the cable.

In the conventional electrical connector disclosed in Patent Reference, when the cable connected to the terminal is inadvertently pulled in an extracting direction of the terminal or a rear direction, the engaging portion of the terminal abuts against the front end surface of the lance portion having the stem-like shape. Thereby, it is possible to prevent the terminal from coming off. When the cable is pulled with a great force, the lance portion tends to buckle upon receiving a buckling stress in a longitudinal direction thereof since the lance portion receives the pulling force via the engaging portion at the front end surface thereof.

In the conventional electrical connector disclosed in Patent Reference, the key member having a box shape closely faces the outer surface of the lance portion. Accordingly, the key member regulates the lance portion to deform outward elastically. As a result, it is possible to prevent the lance portion from buckling outward.

Depending on a force applied to the cable, the lance portion may buckle inward or outward. However, in the conventional electrical connector disclosed in Patent Reference, it is difficult to prevent the lance portion from buckling inward.

In view of the problems described above, an object of the present invention is to provide an electrical connector including a terminal obtained by shaping a metal plate without a complicated configuration, and capable of preventing the lance portion from buckling. It is possible to prevent the lance portion from buckling by regulating the deformation of the lance portion toward both outward and inward.

Further objects and advantages of the invention will be apparent from the following description of the invention.

SUMMARY OF THE INVENTION

In order to attain the objects described above, according to the present invention, an electrical connector (a connector) includes a housing having a terminal hole and a lance portion disposed in the terminal hole. The connector further includes a terminal disposed in the terminal hole. The terminal includes a contact portion for contacting with a mating terminal of a mating connector, a connection portion for connecting a cable thereto, and an engaging portion for engaging the lance portion when the terminal is completely fitted in the terminal hole. The lance portion has a stem-shape and capable of elastic deformation.

The lance portion further includes a guide surface, an engaging front edge surface, and a regulated surface. The guide surface is formed on an inner surface of the lance portion in a shape inclined inwardly toward a front side of the terminal hole. When the terminal is inserted into the terminal hole, the guide surface guides the engaging portion through the terminal hole deforming outward pushed by the engaging portion. When the terminal is completely fitted in the terminal hole, the engaging front edge surface faces the engaging portion from a rear direction being released from the elastic deformation. The regulated surface is arranged to face a mating housing of the mating connector when the electrical connector is connected to the mating connector.

The terminal further includes a curved portion between the contact portion and the connection portion. The engaging portion extends from an upper edge of a sidewall of the curved portion.

In addition, in the connector and the terminal described above, the terminal includes a regulating portion. The regulating portion extends from one sidewall of the curved portion toward the other sidewall of the curved portion. The regulating portion further includes a regulating surface facing the inner surface of the lance portion when the terminal is completely fitted in the terminal hole.

According to a configuration of the present invention, when the terminal is completely fitted in the terminal hole, the engaging portion of the terminal faces the engaging front edge surface of the lance portion in a front to rear direction. Further, the regulating portion of the terminal faces the inner surface of the lance portion in a direction perpendicular to the front to rear direction (a horizontal direction).

In addition, when the connector is connected to the mating connector, the regulated surface formed on an outer surface of the lance portion faces the mating housing of the mating connector in the horizontal direction. Accordingly, when the connector with the terminal inserted therein is connected to the mating connector, if the cable connected to the terminal is pulled unpredictably toward the rear direction or an extracting direction of the connector, the terminal is not extracted from the housing since the engaging portion of the terminal abuts against the engaging front edge surface of the lance portion.

In the present invention, the lance portion does not deform either inward or outward in the horizontal direction, since the regulated surface formed on the outer surface thereof is regulated by the mating housing and the inner surface thereof is regulated by the regulating surface of the terminal, even if the cable is pulled with a great force. As a result, the lance portion does not buckle and maintains a right position securely by abutting against the engaging portion of the terminal. The engaging portion and the regulating portion may extend from either of the sidewalls, respectively.

In the present invention, the engaging portion may extend from one sidewall of the curved portion toward the other sidewall of the curved portion, and the regulating portion may extend from the other sidewall toward the one sidewall. As a result, it is possible to balance heights and strength of both of the sidewalls.

In the present invention, the engaging portion may be formed by curving an engaging arm portion toward one sidewall of the curved portion. The engaging arm portion may be formed by a first slit opening in the rear direction at an upper edge portion of the sidewall. The engaging arm portion may include a rear surface contacting with the one sidewall and a front surface facing the engaging front edge surface of the lance portion when the terminal is completely fitted in the terminal hole.

Since the engaging portion is made from a plate surface of the engaging arm portion, the engaging portion thus formed can obtain a larger facing surface facing the engaging front edge surface of the lance portion, as compared to a case that the facing surface is made from a sectional surface thereof. Thus, the engaging portion obtains a less contacting pressure upon abutting against the engaging front edge surface of the lance portion. As a result, the engaging portion thus formed can lower a possibility of damaging the lance portion and the engaging portion.

When the engaging arm portion contacts with the other sidewall with a tip surface thereof, the tip surface is supported by the other sidewall as the terminal receives an extracting force in the rear direction. Accordingly, the engaging portion can be stronger since the engaging portion has a shape similar to a beam.

In the present invention, the regulating portion may be formed by curving a regulating arm portion toward one sidewall of the curved portion. The regulating arm portion may be formed by a second slit opening in the rear direction at an upper edge portion of the sidewall. The regulating arm portion includes a regulating surface formed on a side surface thereof.

The regulating arm portion receives relatively small force in the horizontal direction, compared to a force the engaging arm portion receives. Thus, the regulating arm portion can obtain strength enough to hold the force with a cantilever form and an area of the side surface thereof. In addition, the regulating portion can obtain easily by curving a regulating arm portion in L-shape, similar to a case that the engaging portion can obtain by curving the engaging arm portion in L-shape.

In the present invention, it is preferable that the regulating portion is arranged to overlap with the regulated surface of the lance portion. As a result, the lance portion can be regulated at approximate the same position in an extending direction thereof, in the both of inner and outer surfaces. Thereby, the lance portion can be regulated further.

In the present invention, the terminal includes the engaging portion engaging the front edge surface of the lance portion. Further, the mating housing of the mating connector regulates the lance portion to deform outward at the regulated surface formed on the outer surface of the lance portion.

In addition, the regulating portion of the terminal regulates the lance portion to deform inward with the inner surface of the lance portion. Accordingly, the lance portion does not buckle either of inward or outward. Thereby, the engaging portion engages the engaging front edge surface of the lance portion stably maintaining a right position thereof. Therefore, it is possible to prevent the terminal from coming off more certainly.

DETAILED DESCRIPTION OF THE PREFERRED EMBODIMENTS

Hereunder, an embodiment of the present invention will be explained with reference to the accompanying drawings.

Figure 1:
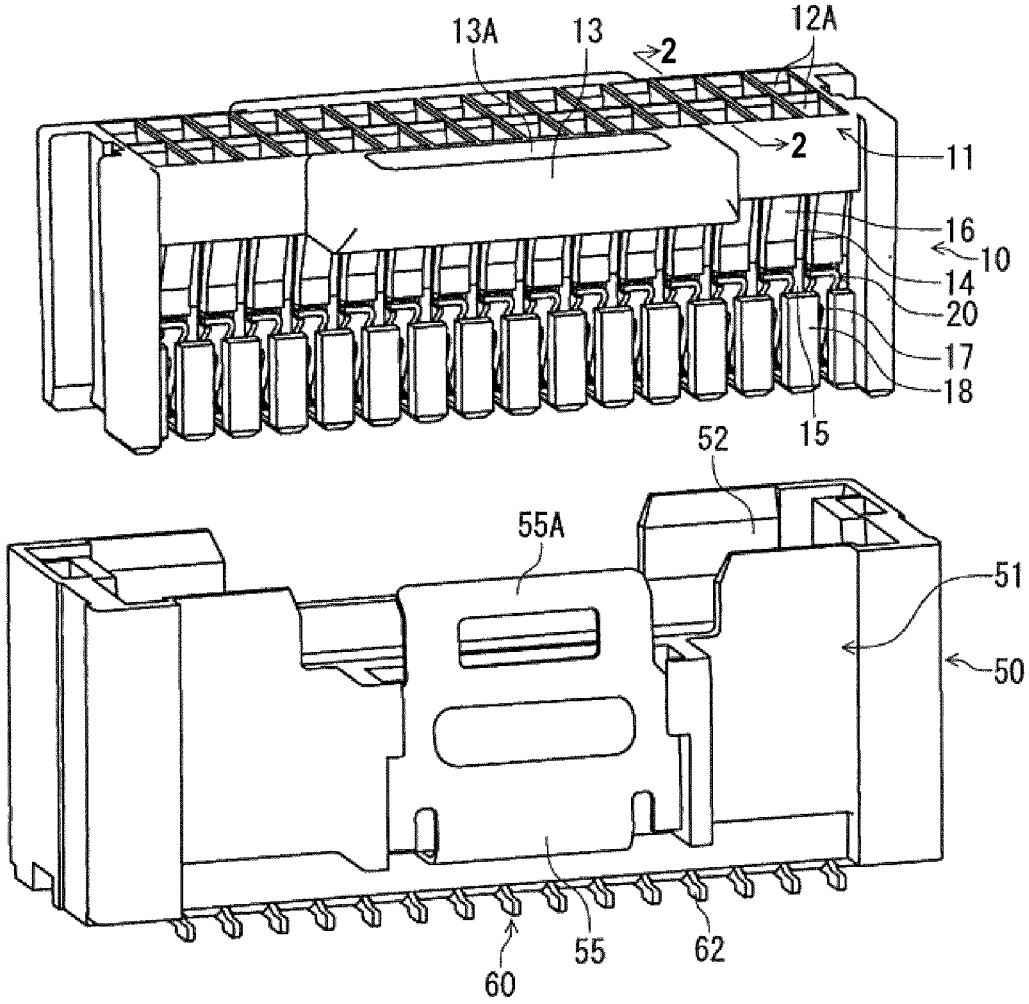
FIG. 1 is a perspective view showing an electrical connector (a connector) and a mating connector according to an embodiment of the present invention.

FIG. 1 is a perspective view showing an electrical connector 10 (a connector 10) and a mating connector 50 in a state before connecting to each other.

As shown in FIG. 1, the connector 10 includes a housing 11 made from an electrical insulating resin and a terminal 20 held by the housing 11. The housing 11 includes a plurality of terminal holes 12. The terminal holes 12 are disposed in a form of two lines and the terminal 20 is inserted into each of the terminal holes 12. The terminal hole 12 penetrates the housing 11 in an upper to lower direction in FIG. 1. The terminal hole 12 includes an upper opening portion 12A and a lower opening portion 12B.

Figure 2:
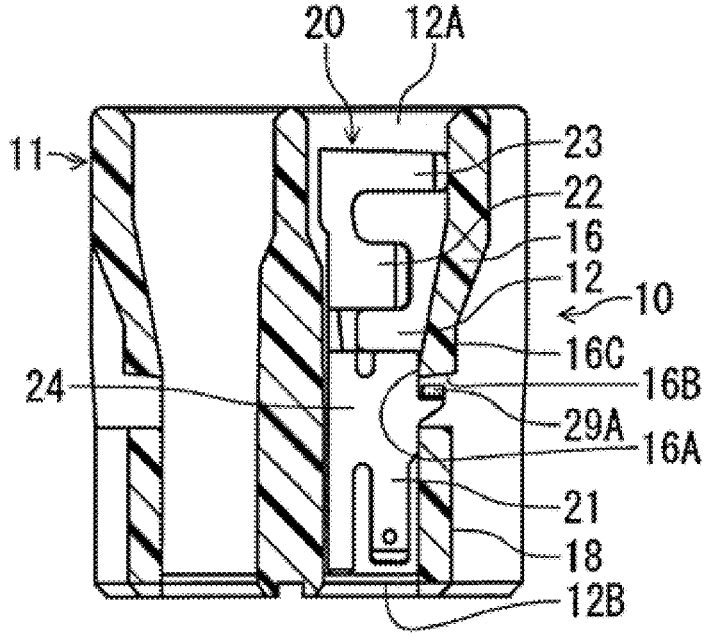
FIG. 2 is a sectional view showing the connector and the mating connector taken along a line 2-2 in FIG. 1 according to the embodiment of the present invention.
Figure 2:
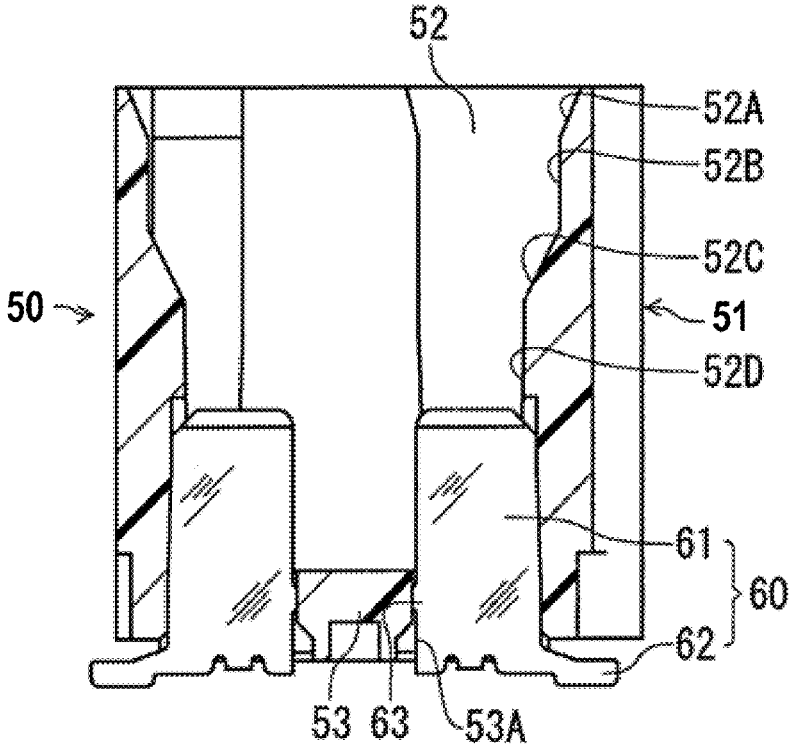

A cable (not shown) connected to the terminal 20 extends from the upper opening portion 12A to outside the housing 11. As shown in FIG. 2, a contacting portion of a mating terminal (described later) of the mating connector 50 enters from the lower opening portion 12B when the connector 10 is connected to the mating connector 50. The housing 11 further includes a protruding portion 13 in an outer wall thereof. The protruding portion 13 includes an engaging hole 13A.

The mating connector 50 includes a mating housing 51 and a mating terminal 60 held by the mating housing 51. The mating terminal 60 is situated at a position corresponding to the terminal 20 of the connector 10. The mating housing 51 includes a receptacle recess portion 52 for receiving a fitting portion of the connector 10. The mating housing 51 further includes an engaging member 55 made from a metal plate being attached to an outer surface thereof. The engaging member 55 prevents the connector 10 from coming off when the connector 10 and the mating connector 50 (the connectors) are connected to each other.

The engaging member 55 includes an engaging portion 55A bent inward at an upper edge portion thereof. The engaging portion 55A engages the engaging hole 13A of the housing 11 of the connector 10. The mating terminal 60 has a flat shape maintaining a plate surface of a metal plate. As shown in FIG. 2, the mating terminal 60 includes a contacting portion 61. The contacting portion 61 penetrates a bottom wall 53 of the housing 50 and is situated in a bottom portion of the receptacle recess portion 52 and extends toward the upper direction. The mating terminal 60 further includes a connecting portion 62 situated at a lower side of the bottom wall 53. The connecting portion 62 is bent and extends in a side direction. Later, the mating connector 50 is explained further, relating to the connector 10.

FIG. 2 is a sectional view showing the connector 10 and the mating connector 50 taken along a line 2-2 in FIG. 1. More specifically, FIG. 2 is a sectional view showing the connector 10 and the mating connector 50 taken along a plane going through a pair of the terminal holes 12 facing each other and being disposed in the form of two lines, in a state before the connectors are connected to each other. The terminal 20 and the mating terminal 60 are not sectioned in FIG. 2. In addition, in order to explain better, the terminal 20 is inserted into the terminal hole 12 situated at a right side in FIG. 2, while the terminal 20 is not inserted into the terminal hole 12 situated at a left side in FIG. 2. In FIG. 2, the cable connected to the terminal 20 is not shown.

As shown in FIGS. 1 and 2, the terminal hole 12 provided in the housing 11 of the connector 10 has an approximate square hole shape extending in a front to rear direction (a lower to upper direction in FIGS. 1 and 2). An inner surface of the terminal hole 12 has wider width at a rear portion thereof or an upper portion thereof in FIG. 2 than the width at a front portion thereof through an inclined inner surface provided between the upper portion and the lower portion thereof. Therefore, as described later, the terminal hole 12 has an appropriate shape for insertion of the terminal 20.

As shown in FIG. 1, the housing 11 includes a rear vertical groove 14 extending from a middle portion to a rear portion thereof in the front to rear direction, at a position a separating wall is situated. The separating wall separates the terminal holes 12 next to each other in a disposing direction or an extending direction of a line the terminal holes 12 are disposed. The housing 11 further includes a horizontal groove 15 communicating with the rear vertical groove 14. Furthermore, the housing 11 includes a lance portion 16 carved by the rear vertical groove 14 and the horizontal groove 15 at a side wall thereof. The lance portion 16 extends in the front to rear direction and has a stem-like shape.

Figure 3:
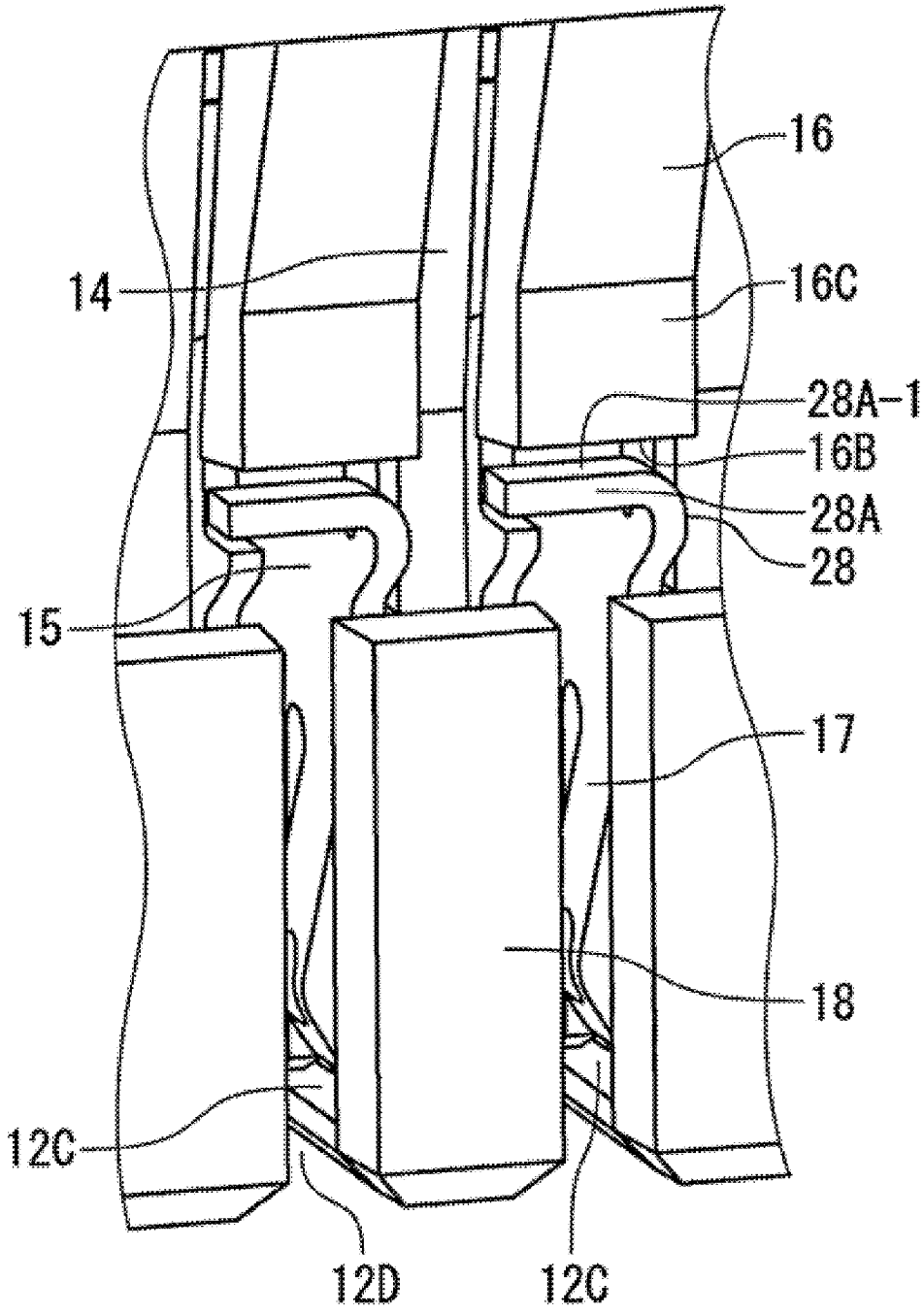
FIG. 3 is a partial enlarged perspective view showing the connector according to the embodiment of the present invention.

FIG. 3 is a partial enlarged perspective view showing the connector 10 at the lance portion 16 and a portion situated at a front side of the lance portion 16 thereof. As shown in FIG. 3, the terminal hole 12 includes a front edge wall 12C. Further, the front edge wall 12C includes a penetrating hole 12D for receiving the contacting portion 61 of the mating terminal 60 of the mating connector 50. The penetrating hole 12D has a slit shape. The penetrating hole 12D communicates with a front vertical groove 17. The front vertical groove 17 is provided in the side wall of the housing 11 and communicates with a horizontal groove 15.

A side wall strip 18 is formed between the front vertical grooves 17 next to each other. Accordingly, as descried above, the rear vertical groove 14 is situated where the separating wall separating the terminal holes 12 is located in the disposing direction while the front vertical groove 17 is situated where a center of the terminal hole 12 is situated in the disposing direction. As a result, as shown in FIGS. 1 and 3, the rear vertical groove 14 is situated against the front vertical groove 17 shifted by half of a disposing pitch of the terminal hole 12 in the disposing direction.

As described above, the lance portion 16 has the stem-like shape formed with the rear vertical groove 14 and the horizontal groove 15 and extends in the front to rear direction. The lance portion 16 has elasticity and is capable of elastic deformation in a horizontal direction or from a right to left direction in FIG. 2. The lance portion 16 includes a guide surface 16A on an inner surface thereof forming the terminal hole 12. The guide surface 16A has a shape inclined inwardly toward a front side of the terminal hole 12. The lance portion 16 further includes an engaging front edge surface 16B at a front edge surface thereof. The engaging front edge surface 16B has a slope inclining toward a rear direction and toward outside the connector 10. In addition, the lance portion 16 includes a regulated surface 16C at a front edge portion of an outer surface thereof extending in the front to rear direction.

Figure 4:
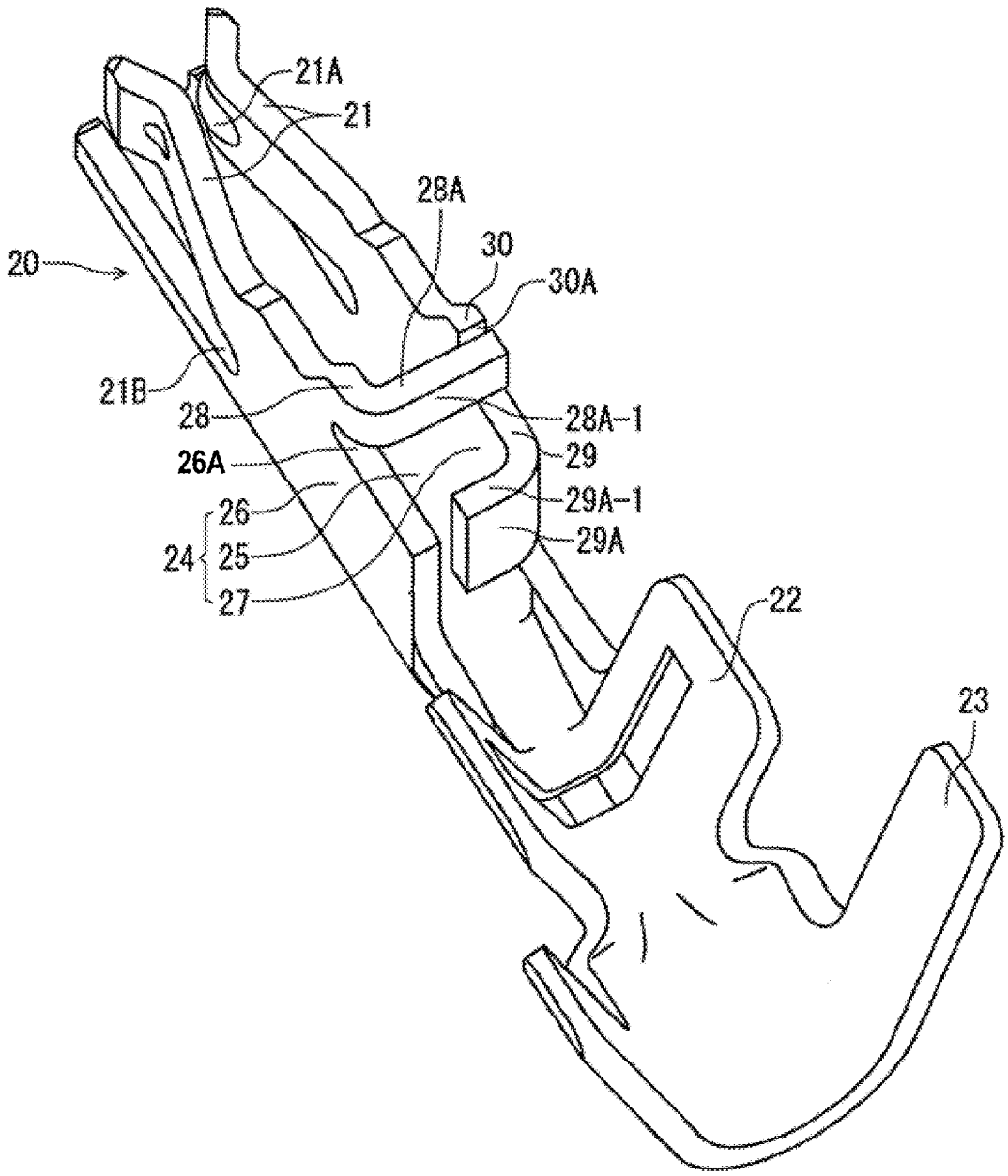
FIG. 4 is a perspective view showing a terminal according to the embodiment of the present invention.
Figure 5:
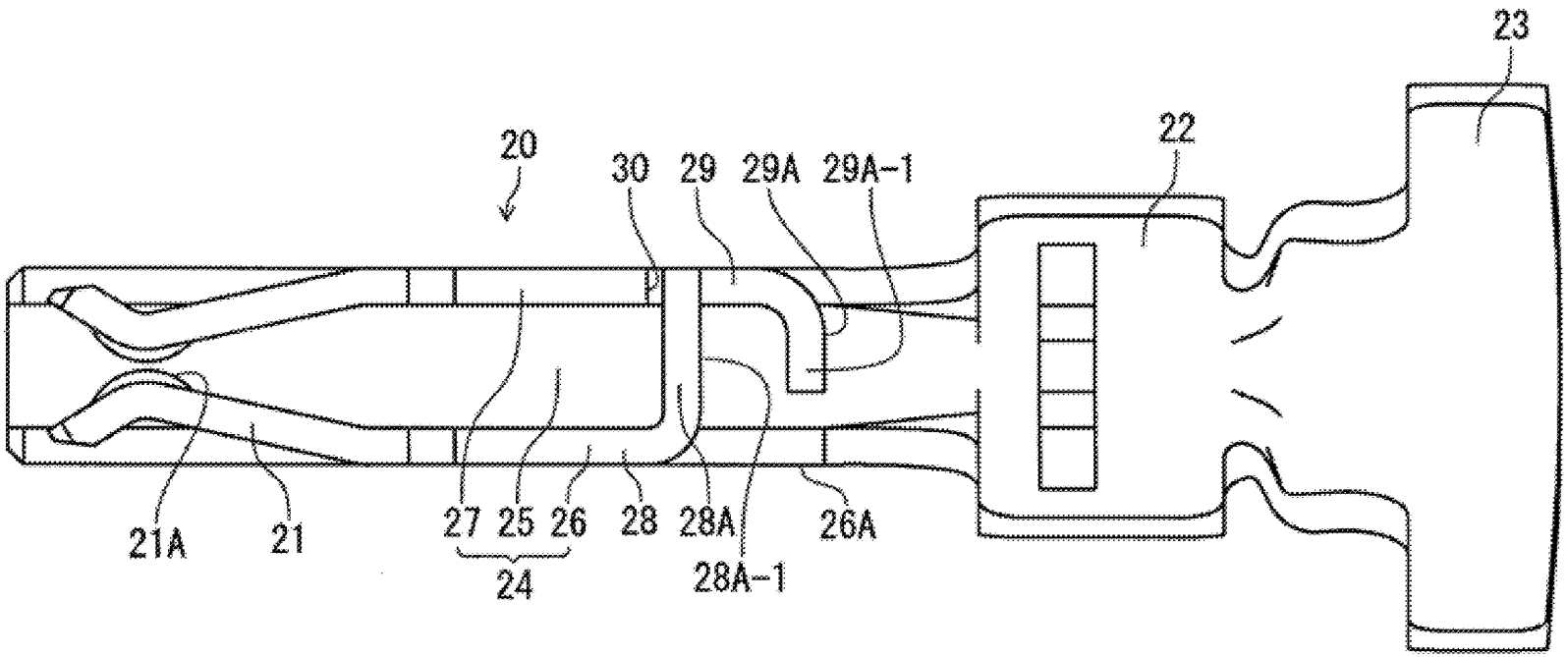
FIG. 5 is a plan view showing the terminal according to the embodiment of the present invention.

FIGS. 4 and 5 are views showing a terminal 20. As shown in FIGS. 4 and 5, the terminal 20 is made by pressing and bending a metal plate. The terminal 20 includes a contacting piece 21 with a contact portion 21A at a front end side thereof, and a connection portion 22 and a holding portion 23 at a rear end side thereof. The terminal 20 further includes a curved portion 24 at a middle portion thereof.

The contacting piece 21 is a pair of pieces provided at wall portions raised from both sides. A slit portion 21B opening toward a front side of the terminal 20 allows the contacting piece 21 to have a free end at a front end side thereof. Each piece of the contacting piece 21 has elasticity and capable of elastic deformation in a direction each piece faces each other. The contact portion 21A is provided at a narrowed portion where each piece comes close to each other, located a closer side to the free end relative to a rear end of the contacting piece 21. When the connector 10 is connected to the mating connector 50, the contacting piece 21 sandwiches and contacts elastically with the mating terminal 60 of the mating connector 50.

The connection portion 22 and the holding portion 23 have a U-shape with both end wall portions being raised and facing each other, respectively. The connection portion 22 and the holding portion 23 are situated next to each other in the front to rear direction. By swaging, the connection portion 22 connects the cable thereto and the holding portion 23 holds the cable. The cable is connected to the terminal 20 with a core thereof at the connection portion 22 and is held with a covering thereof at the holding portion 23.

Configurations of the contacting piece 21 with the contact portion 21A, the connection portion 22 and the holding portion 23 are known. Therefore, further descriptions thereof are omitted.

The terminal 20 includes the curved portion 24 between the contacting piece 21 and the connection portion 22 in the front to rear direction. The curved portion 24 includes a bottom wall portion 25 and sidewalls 26 and 27 raised from both ends of the bottom wall portion 25. Thus, the sidewalls 26 and 27 face each other. In addition, as shown in FIG. 4, the terminal 20 includes an engaging arm portion 28 extending from an edge portion of the sidewall 26 and a regulating arm portion extending from an edge portion of the sidewall 27.

The engaging arm portion 28 is provided with an arm-like shape by opening a first slit 26A to the rear direction at the edge portion of the sidewall 26. Further, the engaging arm portion 28 is curved at a right angle toward the sidewall 27 at nearby a bottom portion thereof. The engaging arm portion 28 includes an engaging portion 28A from the portion curved to a free end thereof. The regulating arm portion 29 is provided with an arm-like shape by opening a second slit 27A to the rear direction at the edge portion of the sidewall 27. The second slit 27A is provided at a position closer to the bottom wall portion 25 than the first slit 26A. Further, the regulating arm portion 29 is curved at a right angle toward the sidewall 26 at nearby a bottom portion thereof. The regulating arm portion 29 includes a regulating portion 29A from the portion curved to a free end thereof. The regulating portion 29A is situated at a lower side of the engaging portion 28A in an upper and lower direction in FIG. 4 or in a direction perpendicular to a sheet in FIG. 5.

The terminal 20 further includes a protruding portion 30 protruding toward the upper direction in FIG. 4, being close to the bottom portion of the regulating arm portion 29. Since the regulating arm portion 29 is situated at the lower side of the engaging portion 28A of the engaging arm portion 28 in the upper and lower direction in FIG. 4, in the embodiment, a front edge surface of the free end side of the engaging portion 28A is close to or abuts against a rear edge surface 30A of the protruding portion 30.

A rear end surface 28A-1 of the engaging portion 28A faces the engaging front edge surface 16B of the lance portion 16 when the terminal 20 is inserted into the terminal hole 12. In addition, the regulating portion 29A is situated close to the sidewall 26 at an edge surface of the free end side thereof. The regulating portion 29A further includes a regulating surface 29A-1 at a thickness surface of the metal plate thereof.

Figure 6:
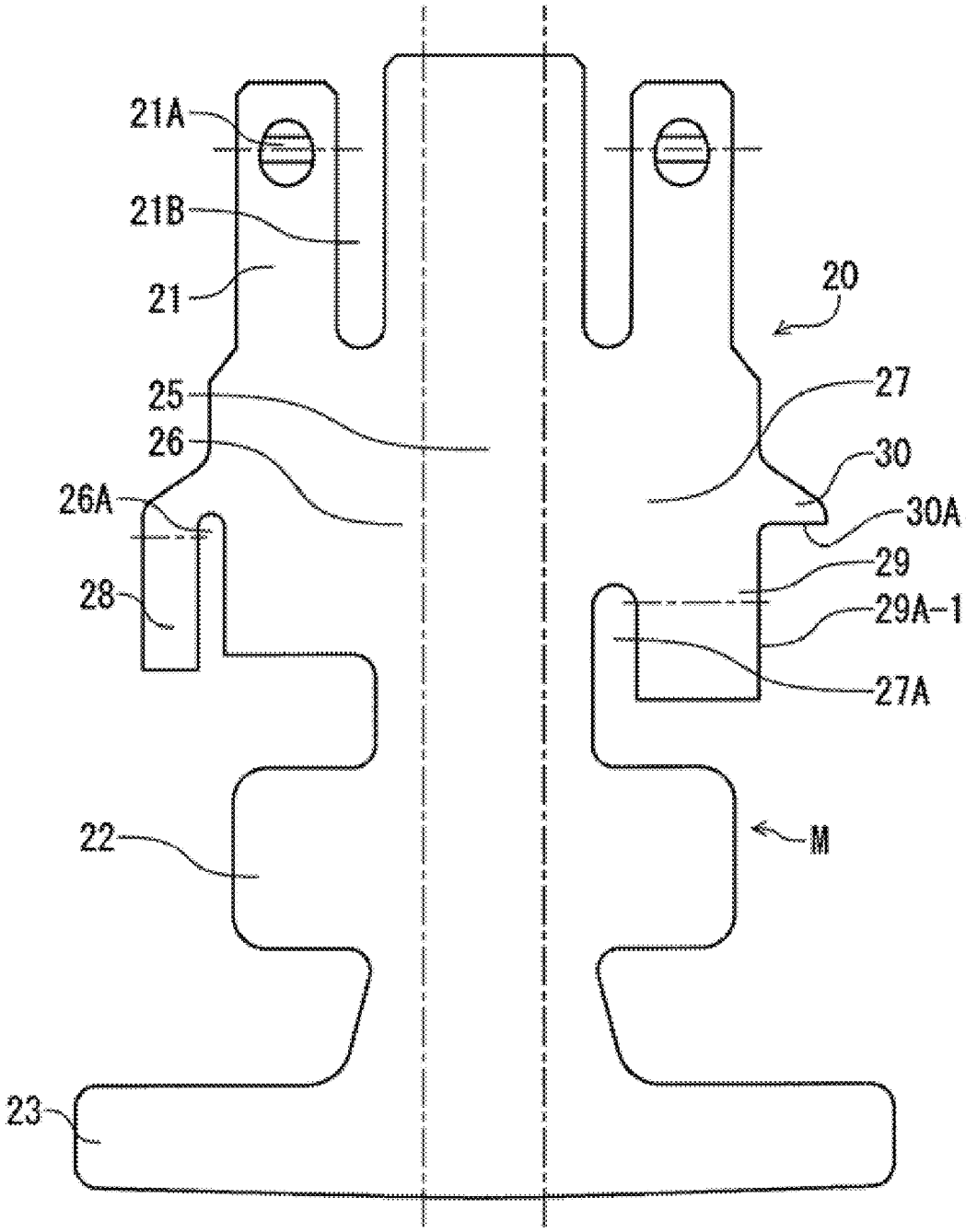
FIG. 6 is a development view showing the terminal according to the embodiment of the present invention.

FIG. 6 is a development view showing the terminal 20. In the embodiment, a metal plate M is pressed into a shape shown in FIG. 6. Then the terminal 20 is made by bending the metal plate M thus pressed along projected lines shown in FIG. 6.

As already described, as shown in FIGS. 1 and 2, the mating housing 51 of the mating connector 50 includes the receptacle recess portion 52 for receiving the connector 10. As shown in FIG. 2, the receptacle recess portion 52 has an inner surface with an appropriate shape for receiving the connector 10. More specifically, the inner surface of the receptacle recess portion 52 includes an introducing sloping surface 52A, a first flat surface 52B, an intermediate sloping surface 52C and a second flat surface 52D in order at a portion thereof facing the outer surface of the lance portion 16 upon receiving the connector 10.

In other words, the receptacle recess portion 52 has the inner surface with a shape fitting to a shape the outer surface of the lance portion 16 at a portion corresponding to the lance portion 16 thereof, upon receiving the connector 10. The second flat surface 52D is situated at a close position to the regulated surface 16C formed in the front edge portion of the outer surface of the lance portion 16 when the connectors are connected to each other.

The mating terminal 60 of the mating connector 50 has the flat shape maintaining the plate surface of the metal plate. The mating terminal 60 includes the contacting portion 61 with the flat plate shape penetrating the bottom wall 53 of the housing 50 and the connecting portion 62 at the lower end thereof in FIG. 2. The contacting portion 61 includes an engaging protrusion 63 provided at one edge thereof, at a side of the bottom wall 53.

When the mating terminal 60 is inserted into the housing 50, the contacting portion 61 is inserted into a penetrating slit 53A provided on the bottom wall 53 of the housing 50. And the engaging protrusion 63 cuts into a side wall portion of the penetrating slit 53A, thereby preventing the mating terminal 60 from coming off from the housing 50. The contacting portion 61 contacts with the terminal 20 of the connector 10 at an upper portion thereof when the connectors are connected to each other. The connecting portion 62 is soldered to a corresponding circuit portion of a circuit board as the mating connector 50 is mounted on the circuit board.

Next, an explanation of operating the connector 10 including the terminal 20 according to the embodiment will be explained.

(1) First, the cable (not shown) is fixed to the terminal 20 by applying a pressure. The cable exposes the core thereof by removing the covering thereof, at a tip portion thereof. The cable is arranged so that the core thereof is situated at the connection portion 22 and a portion covered by the covering thereof is situated at the holding portion 23 of the terminal 20, respectively. The cable is fixed to and held by the terminal 20 by swaging the connection portion 22 and the holding portion of the terminal 20, respectively.

(2) As shown in FIGS. 1 and 2, the terminal 20 thus being connected to the cable is inserted into the terminal hole 12 of the housing 11. The terminal 20 is inserted from the contact portion 21A thereof first, through the upper opening portion 12A. Upon inserting the terminal 20, the engaging portion 28A and the protruding portion 30 abutting against the engaging portion 28A press the guide surface 16A of the lance portion 16 as well as being guided along the inner surface of the lance portion 16 of the housing 11. As a result, the lance portion 16 deforms elastically outward and allows the terminal 20 to be inserted further.

(3) When the engaging portion 28A of the terminal 20 passes through the guide surface 16A of the lance portion 16, the lance portion 16 returns to an original shape thereof being released from the elastic deformation since the lance portion 16 no longer receives a force from the engaging portion 28A. When the lance portion 16 is released from the elastic deformation, the lance portion 16 faces the rear end surface 28A-1 of the engaging portion 28A of the terminal 20 at the engaging front edge surface 16B thereof. Accordingly, the guide surface 16A in the inner surface of the lance portion 16 abuts against the regulating surface 29A-1 of the regulating portion 29A of the terminal 20. As a result, it is possible to prevent the terminal 20 from coming off from the housing 11 though the cable is pulled to a certain extent carelessly, since the engaging portion 28A of the terminal 20 engages the engaging front edge surface 16B of the lance portion 16.

In addition, the lance portion 16 does not deform inward since the regulating surface 29A-1 of the terminal 20 abuts against the inner surface thereof. As described above, as shown in FIGS. 1, 2 and 3, the terminal 20 is inserted into each of the terminal hole 12, thereby the connector 10 is assembled.

Figure 7:
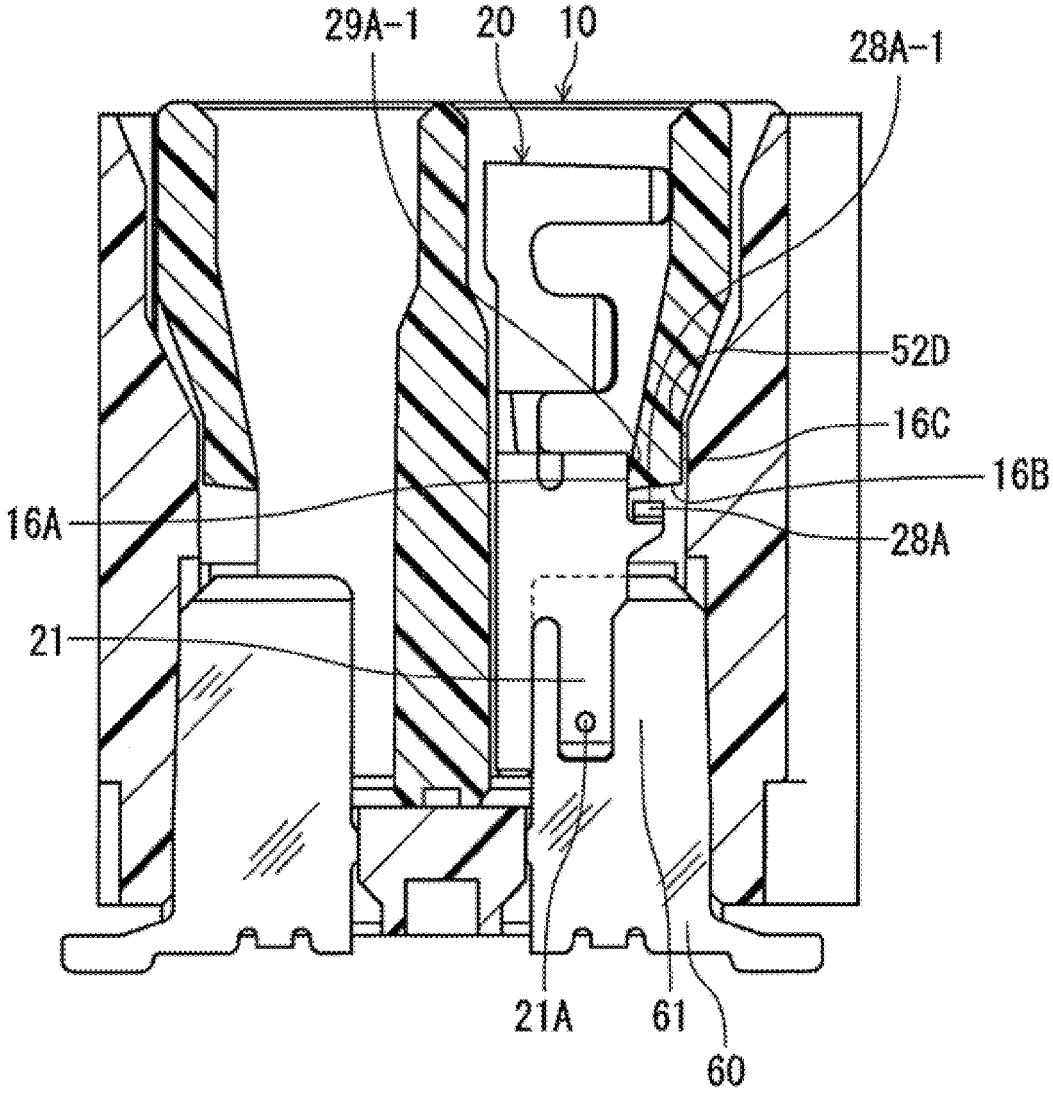
FIG. 7 is a sectional view showing the connector and the mating connector in a state after connecting to each other according to the embodiment of the present invention.

(4) As shown in FIGS. 1 and 2, the connector 10 having the terminal 20 with the cable thus inserted is connected to the mating connector 50 from the upper direction in FIGS. 1 and 2. The mating connector 50 has already been mounted on the circuit board (not shown). As shown in FIG. 7, the connector 10 is connected to the mating connector 50 as the connector 10 is inserted into the receptacle recess portion 52 of the mating connector 50. The contacting portion 61 of the mating terminal 60 of the mating connector 50 enters between the contact portions 21A provided at the narrowed portion of the terminal 20. The contact portion 21A sandwiches the contacting portion 61. As a result, the terminals 20 and 60 contact with each other electrically.

When the connectors are connected to each other, the outer surface of the lance portion 16 of the connector 10 faces the inner surface of the receptacle recess portion 52 of the mating connector 50. More specifically, the regulated surface 16C provided on the outer surface of the lance portion 16 faces closely the second flat surface 52D of the receptacle recess portion 52 of the mating connector 50. Accordingly, due to presence of the second flat surface 52D, the lance portion 16 does not deform elastically outward, even if the cable connecting to the terminal 20 is pulled carelessly.

(5) As described above, the lance portion 16 is regulated the elastic deformation inward thereof by the regulating portion 29 of the terminal 20 of the connector 10. When the connectors are connected to each other, the lance portion 16 is also regulated the elastic deformation outward thereof by the mating housing 51 of the mating connector 50. As a result, the lance portion 16 is situated at a right position without buckling, even if the engaging front edge surface 16B thereof receives a force with a great deal from the engaging portion 28 of the terminal 20. Accordingly, the engaging front edge surface 16B of the lance portion 16 engages the engaging portion 28 more certainly.

In the present invention, embodiments are not limited to the embodiment thus described. For example, the contact portion and the connection portion of the terminal of the connector may have any shape. The contact portion may have a pin shape or a male plate shape. The connection portion may be formed for soldering.

The disclosure of Japanese Patent Application No. 2008-275578, filed on Oct. 27, 2008 is incorporated in the application by reference.

While the invention has been explained with reference to the specific embodiments of the invention, the explanation is illustrative and the invention is limited only by the appended claims.

What is claimed is:

1. An electrical connector, comprising:

a housing including a terminal hole and a lance portion disposed in the terminal hole, said lance portion including a guide surface, an engaging front edge surface, and a regulated surface; and a terminal disposed in the terminal hole, said terminal including a contact portion for contacting with a mating terminal, a connection portion for connecting a cable, an engaging portion for engaging the lance portion, a curved portion formed between the contact portion and the connection portion, and a regulating portion, wherein the engaging portion pushes the guide surface to deform and is guided with the guide surface when the terminal is inserted into the terminal hole, the engaging portion faces the engaging front edge surface when the terminal is completely fitted in the terminal hole, and the engaging portion extends from one sidewall of the curved portion toward the other sidewall of the curved portion, said regulating portion extending from the other sidewall toward the one sidewall.

2. The electrical connector according to claim 1, wherein said guide surface is formed on an inner surface of the lance portion in a shape inclined inwardly toward a front side of the terminal hole.

3. The electrical connector according to claim 1, wherein said regulated surface is arranged to face a mating housing of a mating connector when the electrical connector is connected to the mating connector.

4. The electrical connector according to claim 1, wherein said engaging portion extends from an upper edge of a sidewall of the curved portion.

5. The electrical connector according to claim 1, wherein said regulating portion extends from one sidewall of the curved portion toward the other sidewall of the curved portion.

6. The electrical connector according to claim 1, wherein said regulating portion includes a regulating surface facing the inner surface of the lance portion when the terminal is completely fitted in the terminal hole.

7. The electrical connector according to claim 1, wherein said engaging portion includes an engaging arm portion curved toward one sidewall of the curved portion, said engaging arm portion having a rear surface contacting with the one sidewall and a front surface facing the engaging front edge surface when the terminal is completely fitted in the terminal hole.

8. The electrical connector according to claim 6, wherein said regulating portion includes a regulating arm portion curved toward one sidewall of the curved portion, said regulating arm portion having a side surface with the regulating surface formed thereon.

9. The electrical connector according to claim 1, wherein said regulating portion is arranged to overlap with the regulated surface.

10. A terminal to be disposed in a terminal hole of a housing of an electrical connector, comprising:

a contact portion for contacting with a mating terminal;

a connection portion for connecting a cable;

an engaging portion for engaging a lance portion of the housing;

a curved portion formed between the contact portion and the connection portion; and a regulating portion, wherein the engaging portion pushes a guide surface of the lance portion to deform and is guided with the guide surface when the terminal is inserted into the terminal hole, and the engaging portion faces an engaging front edge surface of the lance portion when the terminal is completely fitted in the terminal hole, and the regulating portion extends from one sidewall of the curved portion toward the other sidewall of the curved portion.

11. The terminal according to claim 10, wherein said engaging portion extends from an upper edge of a sidewall of the curved portion.

12. The terminal according to claim 10, wherein said regulating portion includes a regulating surface facing an inner surface of the lance portion when the terminal is completely fitted in the terminal hole.

* * * * *